United States Patent [19]

Vaughan

[11] 4,219,430

[45] Aug. 26, 1980

[54] MANNICH BASE COMPOSITION

[75] Inventor: Ronald J. Vaughan, Orinda, Calif.

[73] Assignee: Chevron Research Company, San Francisco, Calif.

[21] Appl. No.: 44,605

[22] Filed: Jun. 1, 1979

[51] Int. Cl.[2] ..... C10M 1/54

[52] U.S. Cl. ..... 252/42.7; 252/32.7 E; 252/47.5; 260/570.5 P

[58] Field of Search ..... 252/42.7, 47.5, 51.5 A, 252/51.5 R; 260/570.5 P

[56] References Cited

U.S. PATENT DOCUMENTS

| | | | |
|---|---|---|---|
| 3,065,179 | 11/1962 | Morway et al. | 252/42.7 X |
| 3,230,169 | 1/1966 | Morway et al. | 252/42.7 X |
| 3,586,629 | 6/1971 | Otto et al. | 252/42.7 |
| 3,809,648 | 5/1974 | Hotten | 252/42.7 X |
| 4,175,044 | 11/1979 | Wilgus et al. | 252/47.5 X |

*Primary Examiner*—Andrew Metz

*Attorney, Agent, or Firm*—D. A. Newell; S. R. LaPaglia; V. J. Cavalieri

[57] ABSTRACT

Reacting certain Mannich bases with a methylating agent yields a product having improved zinc dehydrocarbyl dithiophosphate compatability and reduced corrosivity to lead bearings.

7 Claims, No Drawings

MANNICH BASE COMPOSITION

FIELD OF THE INVENTION

This invention relates to an improved Mannich base and to its use in lubricating oil compositions.

BACKGROUND OF THE INVENTION

New varieties of Mannich base compositions have been discovered and are used to meet the need for compositions having a high reservoir of alkalinity of as low as the lower ash content than in conventional acid neutralizing lubricating oil additives. A particularly effective Mannich base composition is that described in U.S. Pat. No. 4,174,044, published Nov. 20, 1979, Ser. No. 838,196 filed Sept. 30, 1977.

Unfortunately, this Mannich base has compatibility problems when mixed with a zinc diisobutylhexyl dithiophosphate.

SUMMARY OF THE INVENTION

It has now been found that reacting a Mannich base, as described in U.S. Pat. No. 4,175,004, published Nov. 20, 1979, (Ser. No. 838,196), with a methylating agent yields a product having improved zinc dithiophosphate compatibility and reduced corrosivity to lead bearings. If desired, the Mannich base may be further reacted with an appropriate alkaline earth metal compound to yield the corresponding salt of the methylated Mannich base.

DETAILED DESCRIPTION OF THE INVENTION

The Mannich bases described in U.S. Pat. No. 4,175,044, published Nov. 20, 1979 (Ser. No. 838,196) are prepared from formaldehyde, a polyamine and a sulfur-containing phenolic mixture consisting of (1) from 5 to 40% of a sulfurized alkyl phenol of the formula

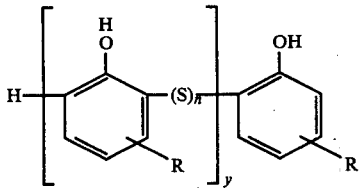

wherein R is $C_8$–$C_{36}$ alkyl, n is an integer from 1 to 8, and y is an integer from 1 to 9, and (2) from 95 to 60% of a phenolic mixture consisting of (a) from 95 to 30% phenol alkylated with a propylene tetramer, and (b) from 5 to 70% phenol alkylated with a straight-chain alpha-olefin of from 16 to about 28 carbon atoms or alpha-olefin mixtures wherein the olefins contain from 16 to about 28 carbon atoms.

Component 1 of the sulfur-containing phenolic mixture is a sulfurized alkyl phenol. These materials are well known for use in lubricating oil. They usually contain from 4 to 20 weight percent sulfur and usually 8 to 18 weight percent sulfur. Various methods for preparing them are disclosed in U.S. Pat. No. 3,741,896.

Component 2*a* of the sulfur-containing phenolic mixture is prepared by alkylating phenol with propylene tetramer. It is also known in the art as tetrapropenyl phenol or dodecyl phenol.

Component 2*b* of the sulfur-containing phenolic mixture is a phenol which has been alkylated with either pure or mixed stream of $C_{16-28}$ carbon atoms alpha olefins. It is important for the effectiveness of the additive that at least one olefin alkylating group contains at least 16 carbon atoms. Thus, the phenol alkylated with, for example, two groups containing 9 carbon atoms each, would not, when used to prepare additives of this invention, provide adequate performance, especially from the standpoint of forming a product with viscosities suitable for use in commercial operations.

Mixtures of alpha-olefins, available on a commercial basis, are suitable for alkylation of the phenols of this invention. These mixtures normally contain predominantly $C_{20-28}$ olefins but may also contain a small proportion of olefins having less than 16 and more than 28 carbon atoms. A representative olefin mixture is Dailen 208, manufactured by Mitsubishi.

Preferred olefins are those which are a mixture of about 60 to 80 mol percent of $C_{18}$–$C_{28}$ alpha olefins and about 40 to 20 mol percent $C_{24}$–$C_{28}$ alpha olefins.

The percent of each phenolic compound from group 1 and group 2*a* and 2*b* used in the phenolic mixture is based on the phenol equivalents calculated from the measured hydroxyl number of each.

Formaldehyde or a formaldehyde precursor, such as paraformaldehyde is used to prepare the condensation product of this invention.

The polyamines for use in this invention are the well known ethylene amines, specifically ethylene diamine, diethylene triamine, triethylene tetraamine, tetraethylene pentamine and pentaethylene hexamine. These compounds are usually prepared by the reaction of an alkylene chloride with ammonia. This reaction yields a somewhat complex mixture of alkylene amines, including some cyclic condensation products. These mixtures are also included within the scope of the term "polyamine".

Also included within the scope of the term "polyamine" are those amines prepared by reaction of acrylonitrile with an ethylene amine as described above, or with an amine of the formula $H_2N—(CH_2)_xNH_2$ where x is 3–6, followed by reduction of the resultant intermediate. For example, the product prepared from ethylene diamine and acrylonitrile would be $H_2N—(CH_2)_3N-H—(CH_2)_2NH—(CH_2)_3NH_2$. Preferred polyamine, for use in this invention, is diethylene triamine.

The Mannich bases can be prepared by conventional methods as described in the art. It is preferred to prepare the Mannich bases by reacting 1 mol of the sulfur-containing phenolic mixture with 0.5–0.85 mol formaldehyde and at least 0.3 mol of polyamine. The reaction is carried out at a temperature of 25°–140° C., preferably 25°–130° C., and in the presence of a suitable solvent, such as benzene or toluene, which can be recovered from the reaction product. If desired, the reaction may be carried out in a mineral lubricating oil and the condensation product is recovered as a lubricating oil concentrate.

After formation of the Mannich base, the unreacted ends of the polyamine are capped using a well-known methylating agent, such as methyl iodide or methyl bromide or the like. The preferred methylating agent is a mixture of formaldehyde and formic acid in the ratio of 1 mol formaldehyde and 2 to 4 mols of formic acid per mol of nitrogen in the Mannich base to be methylated. The methylation reaction is carried out at a temperature between the freezing point and the reflux point of the mixture. Ordinarily, the reaction is run at a temperature from 0° C. to 80° C. and proceeds to completion within about 0.5 to 5 hours. While the reaction is preferably carried out at atmospheric pressure, higher or lower pressures may be used if desired.

Alkaline earth metal salts of the methylated Mannich bases of this invention are particularly useful as lubricating oil additives. The preferred alkaline earth metal salts are calcium and magnesium.

The alkaline earth metal salts of the Mannich bases are prepared using conventional methods, for example, by treating the Mannich base with an alkaline earth metal hydroxide, such as calcium hydroxide or magnesium methoxide, in the presence of a promoter, such as water, ethylene glycol, 1,3-propane diol, 1,4-butane diol, diethylene glycol, butyl cellosolve, propylene glycol, 1,3-butylene glycol, methylcarbitol, diethanol amine, N-methyldiethanol amine, dimethyl formamide, N-methyl acetamide, or dimethyl acetamide. Preferred promoters are water, ethylene glycol and dimethyl acetamide. Most preferred is ethylene glycol. The reaction is carried out at 100°-175° C. After the reaction is completed, the product is stripped at a higher temperature, such as at 175°-202° C. and at reduced pressure, for example, 20 mm Hg, to remove any unreacted low-molecular-weight polyamines, such as ethylene diamine and diethylene triamine, and other volatile components.

The Mannich bases and the alkaline earth metal salts thereof of this invention provide high alkalinity value while maintaining compatibility with zinc dibutyl/-hexyl dithiophosphates.

The lubricant compositions of this invention are prepared by admixing through conventional admixing techniques the appropriate amount of the methylated Mannich base or the alkaline earth metal salt thereof with a lubricating oil. The selection of the particular base oil depends on the contemplated application of the lubricant and the presence of other additives. Generally the amount of the Mannich base for the alkaline earth metal salts thereof used in the lubricating oil will vary from 0.1 to 40% by weight and preferably from 3 to 35% by weight.

The lubricating oil which may be used in this invention includes a wide variety of hydrocarbon oils, such as naphthenic bases, paraffin bases and mixed base oils. The lubricating oils may be used individually or in combination and generally have a viscosity which ranges from 50 to 5000 SUS and usually from 100 to 1500 SUS at 38° C.

In many instances, it may be advantageous to form concentrates of the Mannich base or the alkaline earth metal salts thereof of this invention within a carrier liquid. These concentrates provide a convenient method of handling and transporting the additives of this invention before their subsequent dilution and use. The concentration of the methylated Mannich base or the alkaline earth metal salt of the methylated Mannich base within the concentrates may vary from 85 to 40% by weight, although it is preferred to maintain the concentration between about 50 and 70% by weight.

As desired, other additives may be included in the lubricating oil compositions of this invention. These additives include antioxidants or oxidation inhibitors, dispersants, rust inhibitors, anticorrosive agents, and so forth. Of particular interest are overbased sulfonates. Other types of lubricating oil additives which may be employed include anti-foam agents, stabilizers, antistain agents, tackiness agents, antichatter agents, dropping point improvers, antisquawk agents, extreme pressure agents, odor control agents, and the like.

EXAMPLES

Example A

Into a reaction vessel are introduced 18,100 parts of phenol alkylated with propylene tetramer, 750 parts of calcium oxide and 4620 parts of sulfur, the temperature of the mixture being maintained at 220° F. (104° C.). The temperature is then raised to 265°-275° F. (130°-136° C.) and 580 parts of ethylene glycol is charged. Hydrogen sulfide begins to evolve and a low-rate nitrogen purge is begun over the top of the reactor. The temperature is slowly raised to 335°-340° F. (169°-171° C.) and the temperature maintained for a period of 6 hours. The mixture is then cooled and the product isolated.

The following examples are presented to illustrate the practice of specific embodiments of this invention and should not be interpreted as limitations on the scope of the invention.

EXAMPLE 1

To a 3-liter 3-neck flask was added 400 g neutral diluent lubricating oil, 340 g (1.2 equivalents) of phenol alkylated with propylene tetramer, 198.7 g (0.4 equivalents) of phenol alkylated with a mixture of 70% alpha olefins of 18 to 28 carbon atoms, and 30% alpha olefins of 24 to 28 carbon atoms and 170 g (0.4 equivalents) of sulfurized alkylphenol. The reaction mixture was heated to 70° C. and 103.2 g (1.0 mols) diethylene triamine was added. The mixture is stirred for 10 minutes, and then 47 g paraformaldehyde (1.5 mols formaldehyde) was added. The mixture exothermed to 98° C. It was then heated to 125° C. over a period of 1 hour and held at 125°-130° C. for 1 hour. After cooling the reaction mixture to 60° C., 104.5 g (2 mols) of formic acid was added over a 15-minute period. The reaction mixture exothermed to 78° C. There was then added 63.2 g paraformaldehyde (2 mols formaldehyde) over a period of 8 to 10 minutes. Heavy evolution of gas caused loss of about 10 g of the mixture. The reaction vessel was cooled to 80° C. and stirred until the heavy evolution of gas subsided. It was then heated slowly to reflux at 105°-107° C. and held there for one hour followed by stripping to 130° C. at atmospheric conditions. After cooling the reaction mixture to 110° C., 62 g (1.0 mols) ethylene glycol was added. The mixture is stirred for 10 minutes at 95° C. and then 123 g (1.66 mols) calcium hydroxide was added over a 10-minute period. The mixture was heated to 175° C. over a period of one hour and held at 175°-182° C. for one hour. It was then stripped to 202° C. at 20 mm Hg and held at these conditions for 30 minutes. The product was filtered through diatomaceous earth to yield a product having an alkalinity value of 191 and containing 2.59% nitrogen as a concentrate containing 30.5% oil.

EXAMPLE 2

To a 3-liter 3-neck flask was added 250 g of neutral diluent lubricating oil, 340 g of phenol alkylated with propylene tetramer, 198.7 g of phenol alkylated with a mixture of 70% alpha olefins of 18 to 28 carbon atoms and 30% alpha olefins of 24 to 28 carbon atoms and 170 g of the phenol prepared in Example A. The mixture was heated to 70° C. and 55 g diethylene triamine was added. The mixture was stirred for 10 minutes and 47.3 g of paraformaldehyde was added. The mixture exothermed to 90° C. and then was heated to 125° C. over a period of one hour and held at 125°-130° C. for an additional hour. Then, to the reaction mixture at 60° C. was added dropwise 157 g formic acid over a period of 15 minutes. The mixture exothermed to 86° C. It was cooled to 70° C. and then 63.2 g paraformaldehyde was added. After about half of the paraformaldehyde had been added, the mixture became quite viscous and 50 g of neutral lubricating oil was added. The mixture was heated to reflux at 110° C. and then stripped to 130° C. at atmospheric pressure. The reaction mixture was cooled to 110° C. and 62 g ethylene glycol was added. After stirring for 10 minutes, 185 g calcium hydroxide was added over a 20 minute period. The mixture was heated to 175° C. over a one and one-half hour period, held at 175°-180° C. for an additional hour and then stripped to 202° C. at 20 mm Hg and held at this temperature and pressure for 30 minutes. The product had a crude weight of 1330 g, a concentrate containing 22.6% oil. The crude product was then heated to 150° C. and filtered through diatomaceous earth to yield a final product having an alkalinity value of 235 mg KOH and containing 3.32% nitrogen and 3.9% calcium.

EXAMPLE 3

To a 3-liter 3-neck flask was added 250 g 100 neutral lubricating oil, 340 g phenol alkylated with a propylene tetramer, 198.7 g phenol alkylated with a mixture of 70% alpha olefins of 18 to 28 carbon atoms and 30% alpha olefins of 24 to 28 carbon atoms, and 170 g of phenol prepared as in Example A. The mixture was heated to 70° C. and 155 g of diethylene triamine was added. The mixture was stirred for 10 minutes and then 47.4 g paraformaldehyde was added. The reaction mixture exothermed to 89° C. The mixture was then heated to 125° C. over one hour and held at 125° to 130° C. for an additional hour. The mixture was cooled 60° C. and 209 g of 88% formic acid was added over a 15 minute period. The reaction mixture exothermed to 100° C. and was cooled to 90° C. before adding 126 g of paraformaldehyde over a period of 15 minutes. The mixture was heated to 110° C. and refluxed for one hour and then stripped to 130° C. at atmospheric pressure. The mixture is cooled to 110° C. and 62 g ethylene glycol was added. The mixture was stirred for 10 minutes and 185 g calcium hydroxide was added over a 20-minute period at 110° to 112° C. The mixture was then heated to 175° C. over a one-hour period and held at 175° to 180° C. for an additional hour. It was then stripped to 202° C. at 20 mm Hg and held at these conditions for ½ hour. 50 g of 100 neutral lubricating oil was added to yield a 22.4% concentrate of the crude product in oil. This product was filtered through diatomaceous earth to yield a product having an alkalinity value of 227 mg of KOH per g product and containing 3.28% nitrogen and 3.92% calcium.

EXAMPLE 4

To a 3-liter 3-neck flask was added 250 g of 100 neutral lubricating oil, 340 g of phenol alkylated with propylene tetramer, 199 g of phenol alkylated with a mixture of 70% alpha olefins of 18 to 28 carbon atoms and 30% alpha olefins of 24 to 28 carbon atoms and 170 g of the phenol prepared in Example A. The mixture was heated to 60° and 155 g of diethylene triamine was added. The mixture was stirred and then 94.7 g of paraformaldehyde was added over a period of 2 minutes. The reaction mixture exothermed to 100° C. and was then heated over a period of 30 minutes to 130° C. and maintained at this temperature for one hour. Then, at 90° C., 315 g of formic acid was added. The reaction mixture exothermed to 110° C. It was cooled to 90° C. and then 189 g paraformaldehyde was added over a period of 1 hour at 60° to 75° C. The mixture was then heated to reflux at about 100° C. and was refluxed for one hour. The mixture was stripped to a temperature of 130° C. at atmospheric pressure. The mixture was cooled and then heated to 110° C. and 62 g of ethylene glycol was added followed by the addition of 148 g of calcium hydroxide over a period of 10 minutes. The mixture became viscous and 100 additional grams of 100 neutral lubricating oil was added. The mixture was heated to 175° C. over a period of 1½ hours and maintained at this temperature for one hour, then stripped to 200° C. at 20 mm Hg for 30 minutes. The product was filtered through diatomaceous earth to yield a 26% concentrate of product in oil, the entire concentrate weighing 1373 g and containing 2.78% nitrogen and 3.04% calcium.

EXAMPLE 5

To a 3-liter 3-neck flask was added 250 g 100 neutral lubricating oil, 340 g of phenol alkylated with propylene tetramer, 199 g of phenol alkylated with a mixture of 70% alpha olefins of 18 to 28 carbon atoms and 30% alpha olefins of 24 to 28 carbon atoms and 170 g of phenol as prepared in Example A. The mixture was stirred and warmed slightly and then 155 g of diethylene triamine was added. The reaction mixture exothermed to 50°-60° C. Then 94.7 g of paraformaldehyde was added and the mixture was warmed to a temperature of 130° C. over a period of ½ hour and held at this temperature for one hour. The mixture was then cooled and 157 g formic acid and 50 g 100 neutral lubricating oil were added. The reaction mixture was warmed to 80° C. and another 50 g of 100 neutral lubricating oil was added. The mixture was warmed to 96° C. and 21 g paraformaldehyde was added. Then an additional 42 g of paraformaldehyde was added over a period of one hour. The mixture was heated to reflux for one hour and then stripped to a temperature of 130° C. at atmospheric pressure. The mixture was cooled to 90°-100° C. and 63 g ethylene glycol and 163 g calcium hydroxide was added. The mixture was heated slowly to 175° C. and maintained at this temperature for one hour. The mixture was then stripped to 200° C. and 20 mm Hg and maintained at this temperature and pressure for 30 minutes. The mixture was then filtered through diatomaceous earth to yield 1397 g of the product in oil having an alkalinity value of 221 and containing 3.72% nitrogen and 3.75% calcium.

EXAMPLE 6

To a 3-liter flask was added 250 g of 100 neutral lubricating oil, 340 g of phenol alkylated with propylene tetramer, 199 g of phenol alkylated with a mixture of 70% alpha olefins of 18 to 28 carbon atoms and 30% alpha olefins of 24 to 28 carbon atoms and 170 g of phenol as prepared in Example A. To this mixture was added 219.5 g of triethylene tetramine. The mixture exothermed 35° C. It was then heated to 60° C. and 95 g of paraformaldehyde was added. The mixture was heated to 130° C. over a period of 20 minutes and held at this temperature for one hour. Then 157 g formic acid was added at a temperature of 70° to 90° C. followed by the addition of 63.2 g paraformaldehyde and 100 g of 100 neutral lubricating oil. The temperature was maintained at 70° C. for one hour and then heated slowly to reflux and refluxed for 1½ hours. The mixture was stripped to 130° C. and held at this temperature and atmospheric pressure for 20 minutes. Then at 110° C., 62 g ethylene glycol and 148 g calcium hydroxide were added. The mixture was heated to 175° C. and held at this temperature for one hour. The mixture was distilled at 1 mm Hg and 180° C. in a wiped film still for three hours. It was then filtered through diatomaceous earth to yield 1099 g of product in oil having an alkalinity value of 282 and containing 5.1% nitrogen and 3.1% calcium. The product was again stripped through the still at 0.02 to 0.05 mm Hg and 180° C. for about 3 hours. The alkalinity value of the remaining product was 309.5. Then an additional 158 g of 100 neutral lubricating oil was added to yield a product having an alkalinity value of 255 and containing 4.41% nitrogen and 3.21% calcium.

Example 7

The compatibility of the products of this invention was tested with zinc diisobutyl/hexyldithiophosphate by preparing samples in 350 neutral oil blended to contain an alkalinity value of 10 as contributed by the products of this invention. The samples were held at 65° C. for 2-week and 4-week periods and then rated. In the rating system "4" means detectable floc. "4/1" means detectable floc with very slight sediment. "4/2" means detectable floc with slight sediment. "4/3" means detectable floc with heavy sediment and "4/4" means detectable floc with even heavier sediment. "3" means moderate cloud, "2" means slight cloud and "1" means bright. The compatibility of a product prepared according to U.S. Ser. No. 838,196 is given for comparative purposes. This product was prepared using the procedure of that application and a charge mol ratio of 0.6 mols of phenol alkylated with propylene tetramer, 0.2 mols of phenol alkylated with a mixture of 70% alpha olefins of 18 to 28 carbon atoms and 30% alpha olefins of 24 to 28 carbon atoms, and 0.2 mols of the phenol prepared according to Example A, 0.75 mols formaldehyde, 0.5 mols diethylene triamine and 0.5 mols of calcium hydroxide. The product has an alkalinity value of 232 and contains 3.97% calcium and 3.13% nitrogen. The compatibility results are presented in the table below.

TABLE

| Product | Compatability Rating 2 Weeks | 4 Weeks |
|---|---|---|
| Ser. No. 838,196 | 4 | 4/3 |
| Example 1 | | 2/1 |
| Example 2 | | 2/1 |
| Example 3 | 2 | 2/1 |
| Example 4 | 2 | 4/1 |
| Example 5 | 2 | 2 |

What is claimed is:

1. A Mannich base condensation product selected from the group consisting of (A) the Mannich base prepared by first condensing formaldehyde and a polyamine with a sulfur-containing phenolic mixture consisting of (1) from 5 to 40% of a sulfurized alkylphenol

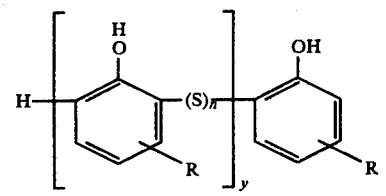

wherein R is $C_8$–$C_{36}$ alkyl, n is an integer from 1 to 8 and y is an integer from 1 to 9, and (2) from 95 to 60% of a phenolic mixture consisting of (a) from 95 to 30% phenol alkylated with propylene tetramer, and (b) from 5 to 70% phenol alkylated with a straight-chain alpha olefin of from 16 to about 28 carbon atoms or with alpha olefin mixtures wherein the olefins are of from 16 to about 28 carbom atoms, followed by methylation of the resultant free amino groups by contacting said Mannich base with a methylation agent, and (B) the alkaline earth metal salts thereof.

2. The alkaline earth metal salt of claim 1 wherein the alkaline earth metal is calcium or magnesium, said straightchain alpha olefin is a mixture of alpha olefins of 16 to about 28 carbon atoms and said methylation agent is formic acid and formaldehyde.

3. A lubricating oil composition comprising an oil of lubricating viscosity and from 0.1 to 40% by weight of the product of claim 1 or 2.

4. A lubricating oil concentrate comprising from 15 to 60% by weight of an oil of lubricating viscosity and from 85 to 40% by weight of a product of claim 1 or 2.

5. A process for preparing a product of reduced lead corrosivity and improved compatability with zinc di(isobutyl/-hexyl) dithiophosphate comprising reacting a Mannich base containing free amino groups with a methylating agent said Mannich base prepared by first condensing formaldehyde and a polyamine with a sulfur-containing phenolic mixture consisting of (1) from 5 to 40% of a sulfurized alkylphenol

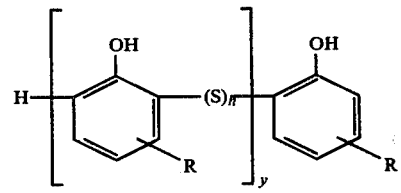

wherein R is a $C_8$-$C_{36}$ alkyl, N is an integer from 1 to 8 and Y is an integer of from 1 to 9, and (2) from 95 to 60% of a phenolic mixture consisting of (a) from 95 to 60% of a phenol alkylated with propylene tetramer, and (b) from 5 to 70% phenol alkylated with a straigh-chain alpha-olefin of from 16 to about 28 carbon atoms or with alpha-olefin mixtures wherein the olefins are of from 16 to about 28 carbom atoms.

6. The product prepared by the process of claim 5.

7. The calcium salt of the product of claim 6.

* * * * *

UNITED STATES PATENT AND TRADEMARK OFFICE

CERTIFICATE OF CORRECTION

PATENT NO. : 4,219,430

DATED : August 26, 1980

INVENTOR(S) : Ronald J. Vaughan

It is certified that error appears in the above-identified patent and that said Letters Patent are hereby corrected as shown below:

Column 1, line 15, "Pat. No. 4,174,044" should read --Pat. No. 4,175,044--.

Column 1, line 23, "Pat. No. 4,175,004" should read --Pat. No. 4,175,044--.

Signed and Sealed this

*Third* Day of *March 1981*

[SEAL]

*Attest:*

RENE D. TEGTMEYER

*Attesting Officer*

*Acting Commissioner of Patents and Trademarks*